US010687689B1

(12) United States Patent
Antonucci

(10) Patent No.: US 10,687,689 B1
(45) Date of Patent: Jun. 23, 2020

(54) FOOTWEAR CLEANING DEVICE

(71) Applicant: Raymond Antonucci, Lake Forest, IL (US)

(72) Inventor: Raymond Antonucci, Lake Forest, IL (US)

( * ) Notice: Subject to any disclaimer, the term of this patent is extended or adjusted under 35 U.S.C. 154(b) by 254 days.

(21) Appl. No.: 15/872,931

(22) Filed: Jan. 16, 2018

Related U.S. Application Data

(60) Provisional application No. 62/448,542, filed on Jan. 20, 2017.

(51) Int. Cl.
*A46B 1/00* (2006.01)
*A46B 15/00* (2006.01)
*A47L 23/04* (2006.01)

(52) U.S. Cl.
CPC ..... *A47L 23/04* (2013.01); *A46B 1/00* (2013.01); *A46B 15/0081* (2013.01); *A46B 2200/306* (2013.01)

(58) Field of Classification Search
CPC ..... A46B 15/0081; A46B 1/00; A47L 23/00; A47L 23/04
USPC ..... D21/795; D32/47
See application file for complete search history.

(56) References Cited

U.S. PATENT DOCUMENTS

| | | | | |
|---|---|---|---|---|
| 327,182 | A | | 9/1885 | Lutz |
| 362,237 | A | | 5/1887 | Warren |
| 2,380,855 | A | | 7/1945 | Lower |
| 2,817,863 | A | | 12/1957 | Johns |
| 2,980,936 | A | | 4/1961 | Snow et al. |
| D190,333 | S | * | 5/1961 | Gunderson ..... D4/118 |
| D191,498 | S | * | 10/1961 | Chamberlain ..... D4/118 |
| 3,045,270 | A | | 7/1962 | Blumlo |
| 3,050,760 | A | | 8/1962 | Darnell |
| 3,111,698 | A | | 11/1963 | Reichle |
| 3,129,448 | A | | 4/1964 | Mittman |
| 3,270,363 | A | | 9/1966 | Harris, Jr. |
| 3,310,826 | A | | 3/1967 | Ellis |
| 3,350,736 | A | | 11/1967 | Frazelle et al. |
| 4,176,417 | A | | 12/1979 | Ruff |
| 4,495,668 | A | | 1/1985 | Adams |
| 4,571,767 | A | | 2/1986 | Dangler |
| 4,667,362 | A | | 5/1987 | Mattingly |
| 4,670,932 | A | | 6/1987 | Williams |
| D347,255 | S | * | 5/1994 | Kerr ..... 15/105 |
| D348,500 | S | * | 7/1994 | Mortenson ..... 15/105 |
| 5,351,356 | A | | 10/1994 | Townsend, Jr. |
| 5,509,167 | A | | 4/1996 | Wilson |
| 5,694,660 | A | | 12/1997 | Rachwalski |
| 6,219,873 | B1 | | 4/2001 | Keuchel |
| 6,302,269 | B1 | | 10/2001 | Risch |
| 6,349,443 | B1 | | 2/2002 | Randolp et al. |
| 6,370,724 | B1 | | 4/2002 | Holmes et al. |
| 6,553,603 | B1 | | 4/2003 | Jolly |
| 6,732,397 | B2 | | 5/2004 | Thompson |
| 7,337,561 | B2 | | 3/2008 | Potashnick |
| 7,437,793 | B2 | | 10/2008 | Lane |
| 7,587,780 | B2 | | 9/2009 | Pfister |
| 8,096,012 | B2 | | 1/2012 | Lubart |

(Continued)

*Primary Examiner* — Randall E Chin

(57) ABSTRACT

A footwear cleaning device includes a handle and a head connected to the handle, the head including spikes on a first portion of the head, a cleat cleaning tool on a second portion of the head, a digging tool on a third portion of the head, a scraping tool on a fourth portion of the head and bristles on a fifth portion of the head.

19 Claims, 6 Drawing Sheets

(56) References Cited

U.S. PATENT DOCUMENTS

| | | | | |
|---|---|---|---|---|
| 8,533,901 | B2 | 9/2013 | Williams | |
| 10,065,093 | B2 * | 9/2018 | Cohens | A63B 57/60 |
| 2003/0228834 | A1 | 12/2003 | Furey | |
| 2005/0217046 | A1 | 10/2005 | Kury | |
| 2008/0263803 | A1 | 10/2008 | Dillow | |
| 2011/0219559 | A1 | 9/2011 | Tanaka et al. | |
| 2012/0006353 | A1 | 1/2012 | Readinger | |
| 2012/0023689 | A1 * | 2/2012 | Weinberger | A47J 43/288 15/111 |
| 2012/0304405 | A1 | 12/2012 | Knopow et al. | |
| 2014/0082868 | A1 | 3/2014 | Naicker | |

* cited by examiner

FOOTWEAR CLEANING DEVICE

RELATED APPLICATION

This patent is a non-provisional application that claims priority to U.S. Provisional Application Ser. No. 62/448,542, which was filed on Jan. 20, 2017, and which is hereby incorporated herein by reference in its entirety.

FIELD OF THE DISCLOSURE

This disclosure relates generally to cleaning devices and, more particularly, to cleaning devices for footwear.

BACKGROUND

The outsole of footwear is the exposed part of the sole that is to be disposed in contact with the ground. Outsoles are made from one or more materials (e.g., polyurethane, urethane, nitrile rubber, styrene butadiene rubber, leather, etc.) to provide a desired coefficient of friction for the intended use(s) of the footwear, and/or to provide a desired appearance, and are configured (e.g., tread pattern(s), tread spacing (s), cleat width(s), channel width(s), etc.) to provide a desired degree of grip, durability and configuration (e.g., a predetermined heel-toe drop, etc.) for such intended use(s).

It is not uncommon for treads footwear having treads and/or cleats to become clogged with debris (e.g., mud, clay, grass, organic matter and/or inorganic matter), such as during precipitation or in the hours or days following precipitation. Whether at athletic fields, parks, yards, mountains, fields or in the suburbs, the presence of debris in the treads and/or around and about the cleats significantly diminishes the performance of the footwear. For instance, clogged treads may prevent water from being properly dispersed throughout the tread pattern and may increase the probability that the outsole will hydroplane and clogged cleats may prevent the cleats from securing proper purchase in the ground during movement, comprising the traction of the footwear and the distribution of pressure, which in turn adversely affects footwear performance (e.g., slipping is increased, speed is decreased, etc.).

Accordingly, when the treads and/or cleats of footwear become fully and/or partially clogged or occluded with debris, the wearer of the footwear or another party (e.g., a parent, a coach, a friend, a teammate, etc.) may be required to attempt to remedy the problem by removing as much debris as possible with whatever implement (e.g., screwdriver, a stick, a small rock, a key, a finger, etc.) is readily available. In some instances, the wearer must remove the footwear to facilitate the cleaning. In some instances, the wearer must also apply a liquid (e.g., water, etc.) to facilitate removal of the debris, such as by scrubbing an outsole under running water in a sink.

While the invention is susceptible to various modifications and alternative forms, an example is presented in the above-noted figures and is described in detail herein. It is to be understood, however, that the invention is not intended to be limited to the particular form disclosed. Rather, the invention is to cover all modifications, equivalents, and alternatives falling within the spirit and scope of the invention as defined by the appended claims. Use of the same reference number in different figures and/or in the accompanying written description is used to denote the same part or like parts.

DETAILED DESCRIPTION

The example footwear cleaning device described herein is a versatile implement able to effectively and assuredly remove debris (e.g., mud, clay, grass, organic matter and/or inorganic matter) from footwear (e.g., outsoles, heel, shank, foxing, midsole, heel stabilizer, heel counter, mudguard or toe cap, etc.). The example footwear cleaning device is configured to remove such debris to restore the footwear, in whole or in part depending on the degree of cleaning effected, to its original (pre-debris) performance level.

The example footwear cleaning device is a vast improvement over the sticks, stones, and screwdrivers currently used to remove debris from footwear. In some examples, the example footwear cleaning device includes a three-in-one tool, a four-in-one tool, or a five-in-one tool providing a variety of implements configured to clean or otherwise dislodge debris from footwear. In some examples, such as the example depicted in FIGS. 1-6, the example footwear cleaning device is a portable, hand-held device configure to enable the wearer of the footwear (e.g., an athlete, etc.), or another party (e.g., a parent, a coach, a friend, a teammate, etc.), to rapidly return the footwear to functionality, minimizing downtime for the wearer of the footwear. For example, an athlete may quickly and effectively remove grass and mud from his or her cleats during a brief pause in the activity. In some examples, the example footwear cleaning device is a stationary device (e.g., a device having a weighted and/or elongated base, etc.) including a plurality of implements (e.g., three tools, four tools, five tools, ten tools, twenty tools, etc.) configured to clean or otherwise dislodge debris from footwear from one or more athletes (e.g., at the same time, concurrently, sequentially, etc.).

Figure 1:
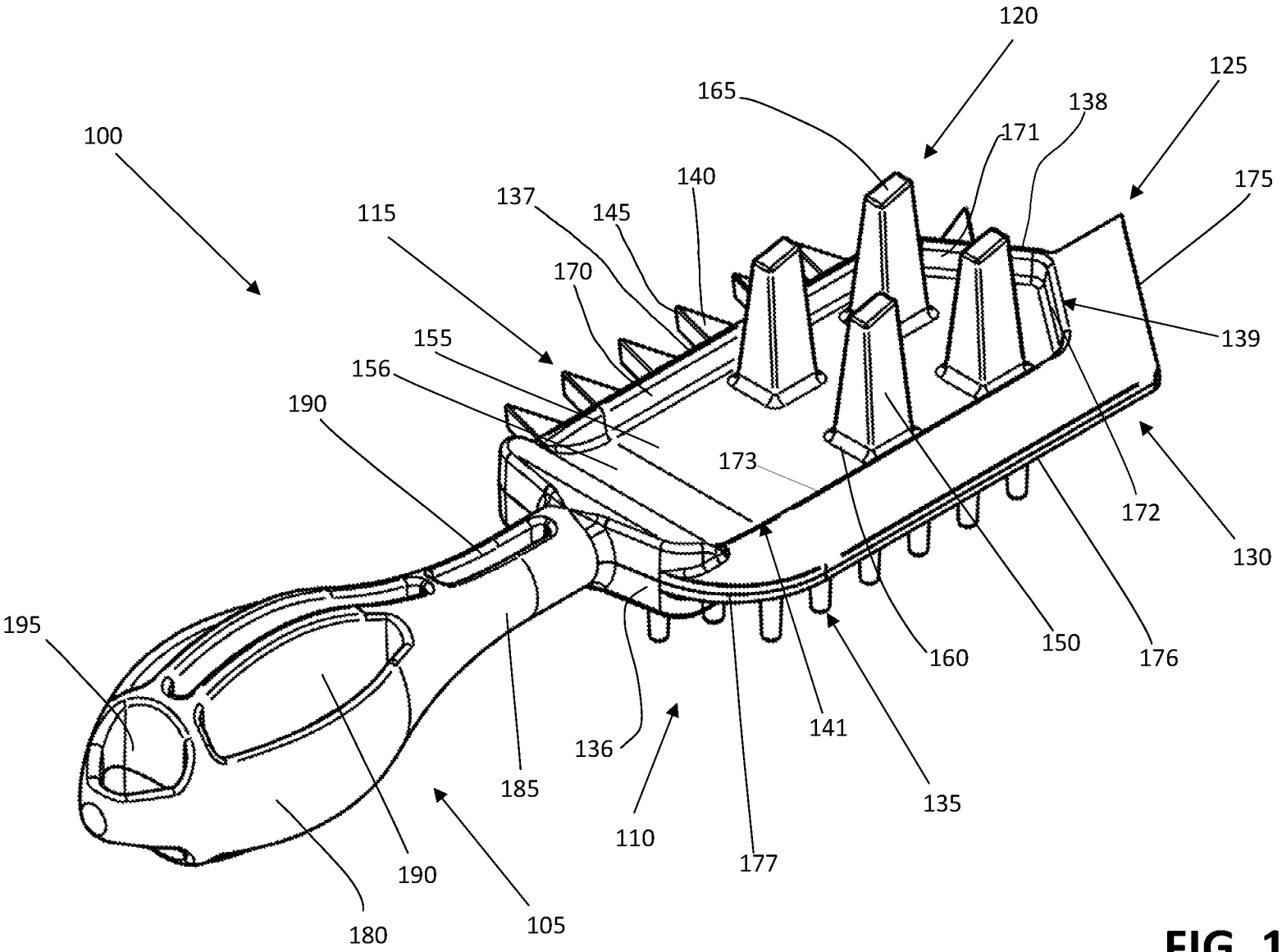
FIG. 1 is a perspective view of an example top side of an example footwear cleaning device in accord with at least some aspects of the present concepts.

FIG. 1 is a perspective view of an example top side of an example footwear cleaning device 100. The footwear cleaning device 100 of FIG. 1 includes an example handle 105 and an example head 110, which includes example spikes 115, example cleat cleaning tools 120, an example digging tool 125, an example scraping tool 130 and example bristles 135. Accordingly, the example head 110 of the example footwear cleaning device 100 presents an example four-in-one tool configured to clean footwear. In accord with the present concepts, the footwear cleaning device 100 may include fewer tools or a greater number of tools and may include a different variety of tools than that presented in the example of FIGS. 1-6.

While the footwear cleaning device 100 is described below, by way of example, in relation to athletes (e.g., athletes who play on natural turf fields and suffer from issues with mud clogging up cleats), the footwear cleaning device 100 is also adept for use with work boots, garden boots, hiking boots and/or winter boots.

In the illustrated example, the footwear cleaning device 100 is a unitary part formed from a plastic or polymer(s). In some examples, the footwear cleaning device 100 is formed via injection molding using a conventional injection molding system (e.g., a screw-based machine having gradual transition zone(s)). In an example injection molding process, an example first step includes clamping shut or otherwise mechanically locking closed a mold defining a mold cavity having a shape of the example footwear cleaning device 100 or another configuration of footwear cleaning device 100 in accord with the concepts disclosed herein. An example second step includes heating an example thermoplastic or thermosetting polymeric material at a temperature and for a time appropriate to the selected material(s) and injecting the heated material into the mold cavity when the material(s) has an appropriate melt viscosity and flow characteristics.

In some examples, the material(s) used to form the footwear cleaning device 100 includes a thermoplastic polyetherester elastomer, such as Hytrel® TPC-ET thermoplastic elastomer resin or a Delrin® acetal homopolymer resin manufactured by DuPont of Wilmington, Del. In an example where the material used to form the footwear cleaning device 100 is Hytrel®, the melt temperature for an example 7246 Grade Hytrel®, is 424° F. and the temperature at which complete melting occurs is 450° F. An example second step may include, accordingly, heating of the Hytrel® to a temperature between about 465° F.–500° F. In some examples, following injection of the Hytrel® into the mold cavity, the dwell temperature may be maintained at an elevated temperature (e.g., 110° F.–140° F.) to help retard cooling and minimize shrinkage and the dwell pressure can be set equal to the injection pressure to maximize packing and hardness. In some examples, the material(s) forming the footwear cleaning device 100 have a Rockwell Hardness between about R90-R150 (e.g., R118).

In an example third step, the material filling the mold cavity is held at a predetermined temperature and at a predetermined pressure (i.e., the dwell or molding temperature and pressure) for a predetermined period of time (i.e., the dwell or molding time). In an example fourth step, following the dwell, the material filling the mold cavity is allowed to cool and solidify. In an example fifth step, after the material filling the mold cavity has cooled and solidified, the mold is opened to enable removal of the formed part (i.e., the footwear cleaning device 100), following which the formed part removed from the mold cavity in an example sixth step.

In some examples, the head 110 is removably attached to the handle, such as via a mechanical fastener (e.g., a threaded connection, a male/female connector, etc.). In such examples, different heads 110 having different combinations of tools, may be attached to the handle 105.

In the example of FIGS. 1-6, the head 100 is in the shape of an irregular pentagon (i.e., a pentagon that does not have all sides equal and all angles equal) having an example first side 136 connecting to the handle 105, an example second side 137 (e.g., a left side) bearing the spikes 115, an example third side 138 (e.g., an upper left side) optionally bearing one or more of the spikes 115, an example fourth side 139 (e.g., an upper right side) bearing the digging tool 125 and optionally a portion of the scraping tool 130, and an example fifth side 141 bearing the scraping tool 130. In other examples, the head 110 may include a different number of sides, a different polygonal shape (e.g., rectangular, etc.), a curvilinear shape (e.g., an oval, an ellipse, etc.) and/or a combination thereof (e.g., a rectangular body with a semi-circular upper portion).

In use, the spikes 115 may be used to remove debris from bumpy surfaces of the outsole or other portion(s) of the footwear, the cleat cleaning tool 120 may be used to clean between and around cleats of the outsole, the digging tool 125 may be used to remove rocks or dried mud (e.g., from within treads, etc.), the scraping tool 130 edge(s) (e.g., a flat edge, etc.) may be used to scrape off flat surfaces, and the bristles 135 may be used to brush away excess debris In some examples, one or more of the spikes 115, the cleat cleaning tools 120, the digging tool 125, the scraping tool 130 and/or the bristles 135 are removable in whole or in part. For example, the four cleat cleaning tools 120 depicted in FIG. 1 may be removable individually (e.g., removably connected via threaded mechanical fasteners, etc.) or as a group (e.g., a snap-fit connector bearing the four cleat cleaning tools 120 depicted can be removed and replaced with another snap-fit connector bearing a different number and/or configuration of cleat cleaning tools). As another example, the bristles 135 depicted in FIGS. 1-6 may be removable individually (e.g., removably connected via threaded mechanical fasteners, etc.) or as a group (e.g., a snap-fit connector bearing the bristles 135 can be removed and replaced with another snap-fit connector bearing a different number and/or configuration of bristles 135).

In the example of FIGS. 1-6, the spikes 115 are disposed along the second side 137 and along the third side 138. The spikes 115 include an example body 140 extending outwardly from a proximal or base end (not shown in FIG. 1) attached to or formed with the second side 137 and terminating at an example distal end 145. In the example of FIGS. 1-6, the distal end 145 is pointed. In other examples, the distal end is rounded, squared off or beveled. In some examples, the spike 115 is about 0.44" high having a body that defines an angle of about 30° at the distal end 145 and angles of 75° at the base. In accord with other examples, the height of the spikes 115 may be less than, or greater than, the example height of 0.44" and the angle defined at the distal end 145 of the spikes may be less than, or greater than, the example angle of about 30°. In some examples, a pitch between adjacent spikes 115 is about 0.45"-0.46". In accord with other examples, the pitch between adjacent spikes 115 may be lower than, or greater than, the example pitch of 0.45"-0.46".

In the example of FIGS. 1-6, the cleat cleaning tool 120 includes four cleat cleaning posts 150 extending outwardly from an example proximal end or base 160 at an example first surface 155 (e.g., an example top side of the example footwear cleaning device 100) to terminate at an example distal end 165. In some examples, a height of the cleat cleaning posts 150 is between about 0.55"-1.25" (e.g., 0.76", 0.92", etc.), but may be of a greater height or a lesser height to facilitate use with one or more cleat sizes (e.g., 3⁄16", ½", ⅜", ¾", etc.) and/or application(s)(e.g., sport, age of participants and applicable rules, turf type, turf condition, environmental conditions, etc.). The cleat cleaning posts 150 are dimensioned to pass between adjacent cleat cleaning posts 150.

In some examples, a width of the cleat cleaning posts 150 in a direction along a length of the footwear cleaning device 100 is about 0.34". In some examples, the cleat cleaning posts 150 have a rectangular cross-sectional shape, a square cross-sectional shape, a circular cross-sectional shape, an oval or elliptical cross-sectional shape, or other polygonal or curvilinear shape.

While FIGS. 1-6 show an example wherein the cleat cleaning tool 120 includes four cleat cleaning posts 150, in other examples the cleat cleaning tool 120 may include one, two, three, or more than four cleat cleaning posts 150.

In the example of FIGS. 1-6, the distal end 165 of the cleat cleaning posts 150 includes a flat or truncated surface defined by a plane that may be parallel to the first surface 155 or that may be at an angle to the first surface 155. For instance, in some examples, the distal end 165 of the cleat cleaning posts 150 may define an angle of between about 5°-20° (e.g., 6°, 12°) relative to the first surface 155 or relative to a perpendicular to a length of the cleat cleaning posts 150. Accordingly, in some examples, a first portion of the distal end 165 (e.g., an end closer to the front of the head 110) is at a higher elevation relative to the first surface than a second portion of the distal end 165 (e.g., an end closer to the base 105). In some examples, the distal end 165 may include a shape other than the depicted flat or truncated surface. For instance, in some examples, the distal end 165 may taper along two sides to a point along a line or may taper along four sides to form a point (e.g., a pyramid shape).

In some examples, an overall length of the example footwear cleaning device 100 is between about 8.32"-8.36." In some examples, the handle 105 is about 3.95" long and an overall length of the head 110 from the handle 105 to a distal end of the digging tool 125 is about 4.4". In some examples, an overall width of the head 110 from distal ends 145 of the spikes 115 to the second edge 176 of the scraping tool 130 is between about 2.24"-2.46". In some examples, the scraping tool 130 extends outwardly from the head 100 by about 0.46".

In the example of FIGS. 1-6, the example first surface 155 is slightly recessed within the head 110 and is bounded by an example first wall 156 downwardly sloping from an example reinforced connection between the handle 105 and the head 110, an example second wall 170, an example third wall 171, an example fourth wall 172 and an example fifth wall 173. In some examples, a height of the second wall 170, the third wall 171 and the fourth wall 172 relative to the first surface 155 is between about 0.05"-0.20". In another example, the first surface 155 is not recessed and the head 110 omits the second wall 170, the third wall 171, the fourth wall 172 and the fifth wall 173. In some examples, the second wall 170, the third wall 171, the fourth wall 172 and the fifth wall 173 are vertical walls (i.e., perpendicular to the first surface 155). In some examples, the second wall 170, the third wall 171, the fourth wall 172 and the fifth wall 173 are at an obtuse angle (e.g., greater than) 90° relative to the first surface 155 (e.g., 93°, etc.) to define an outward cant.

In the example footwear cleaning device 100 of FIGS. 1-6, the digging tool 125 is integrated with the scraping tool 130. In some examples, the digging tool 125 is separate from the scraping tool 130. In some examples, the digging tool 125 is spatially set apart from other tools to permit the digging tool 125 to be implemented to clean footwear (e.g., an outsole, etc.) without interference by any of the other tools.

In some examples, the digging tool 125 is integrated into the handle 105, such as at the end of the handle 105. In some examples, the digging tool 125 is movable. For instance, the digging tool 125 may be connected to the head 110 by a hinge enabling the digging tool 125 to be moved from a stowed position to an operable, locked and deployed position. In some examples, the digging tool 125 is removable and may include, for example, a digging tool 125 in the form of a pick that is removably housed within a chamber formed in the handle 105.

The depicted digging tool 125 extends outwardly from the head 110 (e.g., from the third side 138 and/or the fourth side 139) by about 0.55" and, as shown, is integrated with the first edge 175 of the scraping tool 130. In some examples, the digging tool 125 is separate from the scraping tool 130. The first edge 175 of the scraping tool 130 is disposed about 0.41" from the fourth side 139 and/or fourth wall 172 of the head 110. In some examples, a height or thickness of the first edge 175 is about 0.18". In some examples, a height or thickness of the scraping tool 130 between the first edge 175 and the fourth side 139 and/or the fourth wall 172 is about 0.18". In some examples, a height or thickness of the scraping tool 130 tapers from a first thickness greater than about 0.18" at the fourth side 139 and/or the fourth wall 172 to about 0.18" at the first edge 175. In some examples, the taper is between 1°-5° (e.g., 3°). In some examples, the first edge 175 is flat. In some examples, the first edge 175 is angled or beveled (e.g., a convex edge, a sabre edge, a chisel edge, a Scandi edge, a V-edge, a double beveled edge, etc.).

The second edge 176 of the scraping tool 130 is disposed about 0.41" from the fifth side 141 and/or fifth wall 173 of the head 110. In some examples, a height or thickness of the second edge 176 is about 0.18". In some examples, a height or thickness of the scraping tool 130 between the second edge 176 and the fifth side 141 and/or fifth wall 173 is about 0.18". In some examples, a height or thickness of the scraping tool 130 tapers from a first thickness greater than about 0.18" at the fifth side 141 and/or fifth wall 173 to about 0.18" at the second edge 176. In some examples, the second edge 176 is flat. In some examples, the second edge 176 is angled or beveled (e.g., a convex edge, a sabre edge, a chisel edge, a Scandi edge, a V-edge, a double beveled edge, etc.). The first edge 175 may be similar to, or different than, the second edge 176. In some examples, the second edge 176 is radiused at the example third edge 177, which merges into the head 110 in a region where the head 110 connects to the handle 105. In some examples, the third edge 177 is chamfered. In some examples, the third edge 177 is substantially perpendicular to the head 110 and/or the second edge 176.

FIGS. 1-6 show the handle 105 to include an example grip 180 and an example neck 185. In some examples, a width or diameter of the neck 185 is about 0.51" and a width or diameter of the grip 180 at its widest point is about 1.42". The example grip 180 and/or the example neck 185 includes example cavities 190 which may extend partially into the grip 180 and/or the neck 185, or which may define through-holes that extend from one side of the grip 180 and/or the neck 185 to an opposing side of the grip 180 and/or the neck 185. In some examples, the handle 105 defines a lanyard hole 195 to facilitate attachment of a lanyard or a carabiner to facilitate removable attachment of the footwear cleaning device 100 to, for example, an equipment bag, a strap, a belt loop, a backpack or a bag. In some examples, the grip 185 of the handle 105 does not include the cavities 190. In some examples, the neck 185 of the handle 105 does not include the cavity 190.

Figure 2:
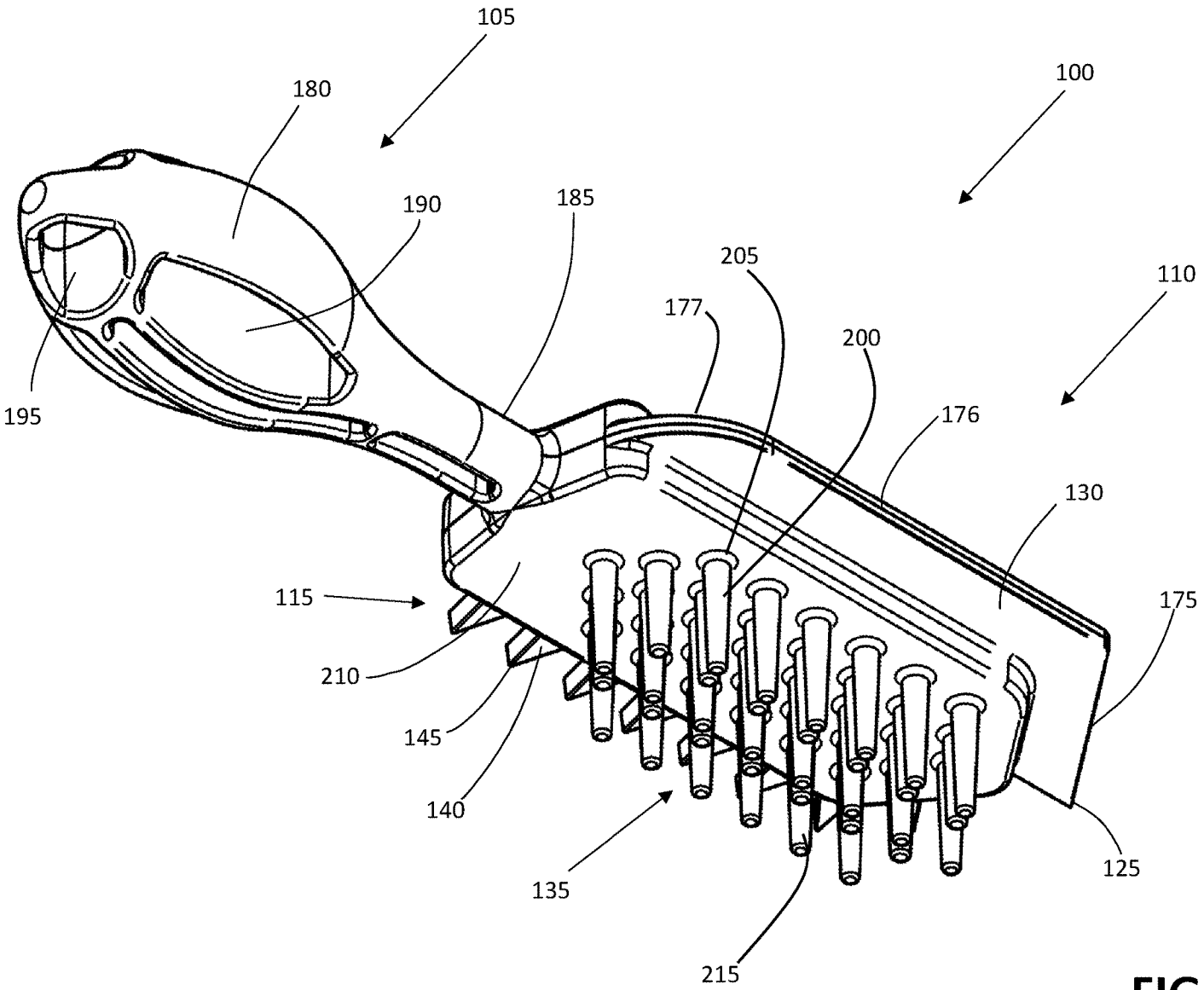
FIG. 2 is a perspective view of an example bottom side of the example footwear cleaning device of FIG. 1 in accord with at least some aspects of the present concepts.
Figure 3:
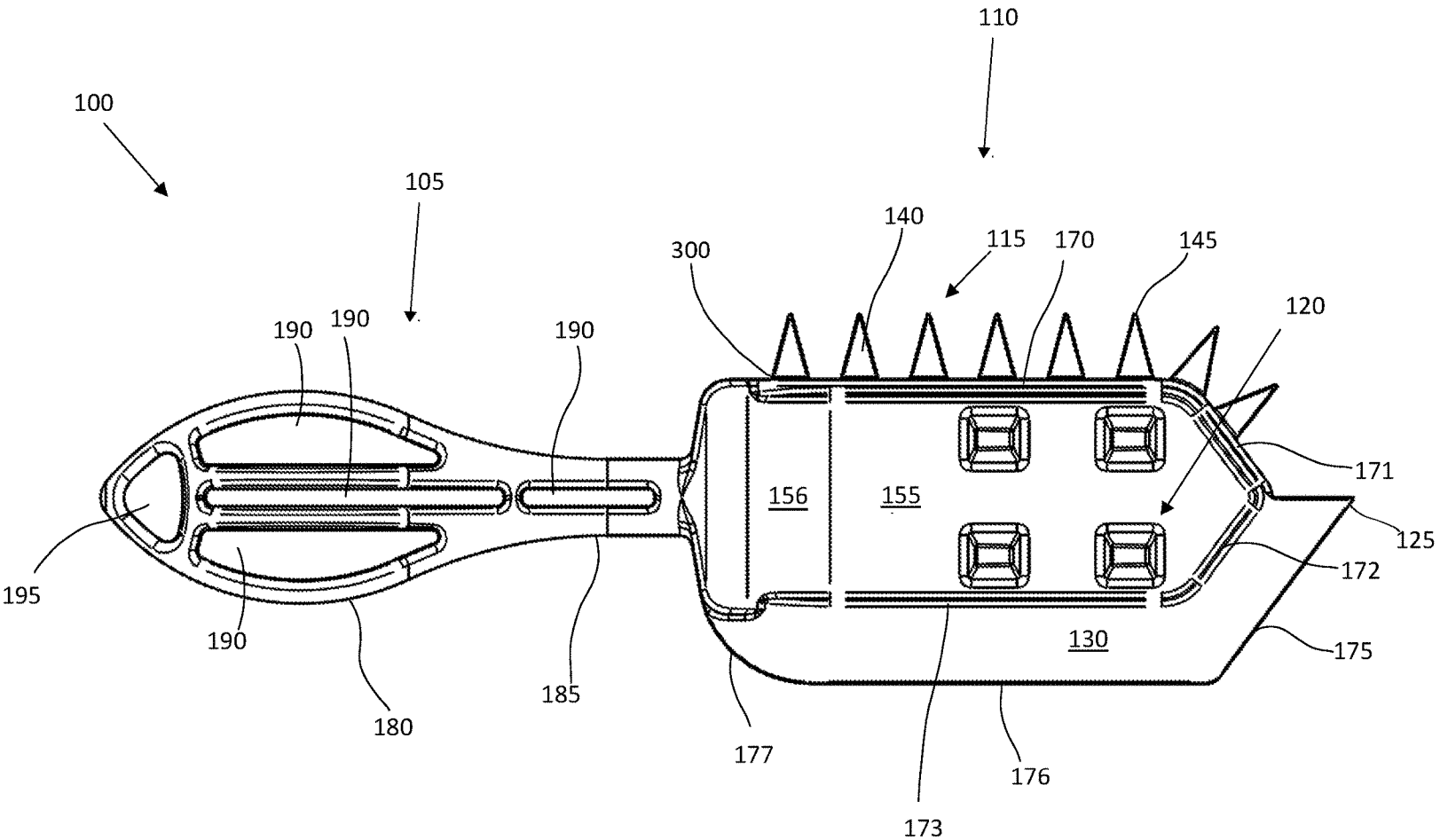
FIG. 3 is a top view of the example footwear cleaning device of FIGS. 1-2 in accord with at least some aspects of the present concepts.
Figure 4:
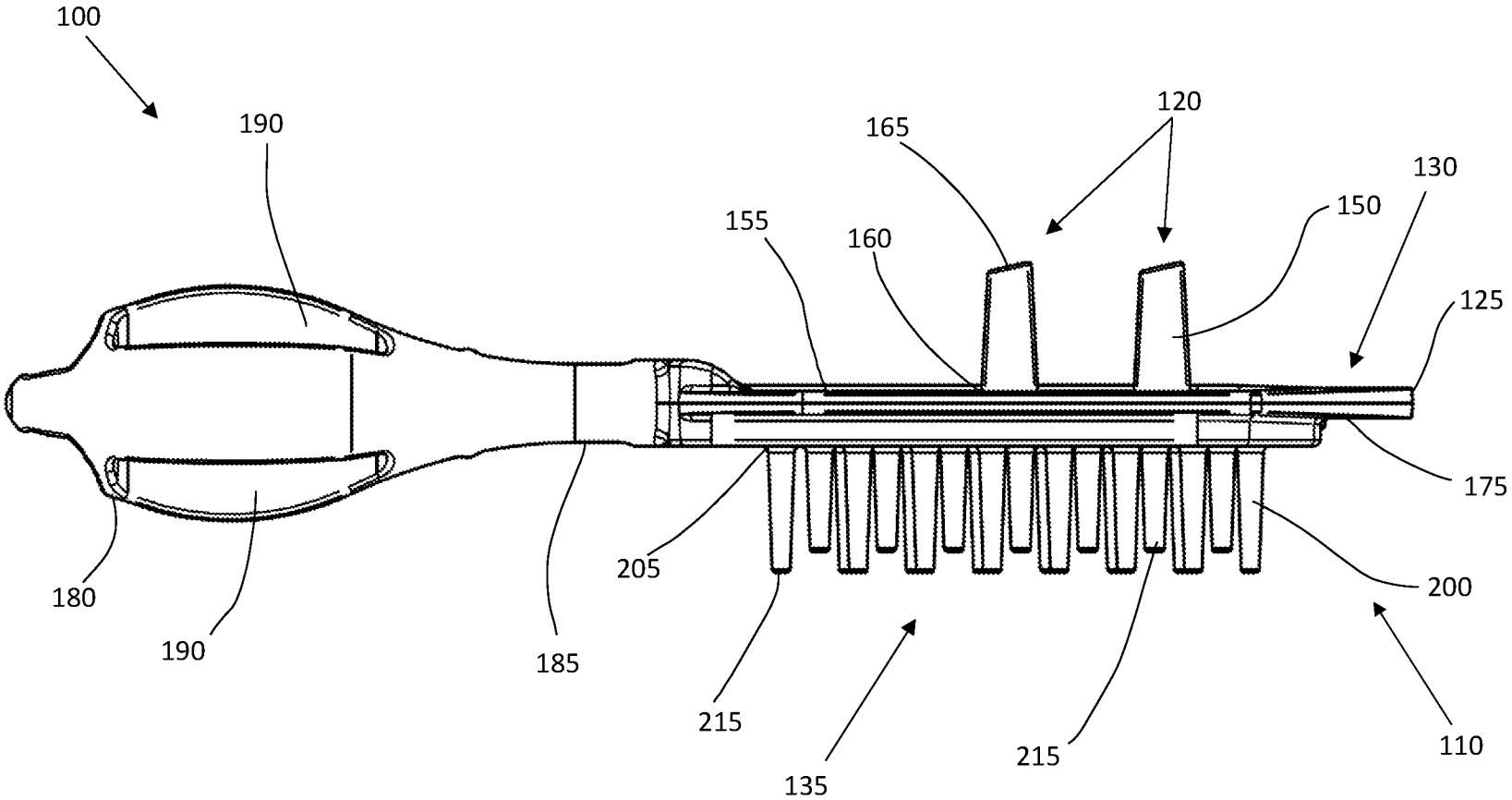
FIG. 4 is a side view of the example footwear cleaning device of FIGS. 1-3 in accord with at least some aspects of the present concepts.
Figure 5:
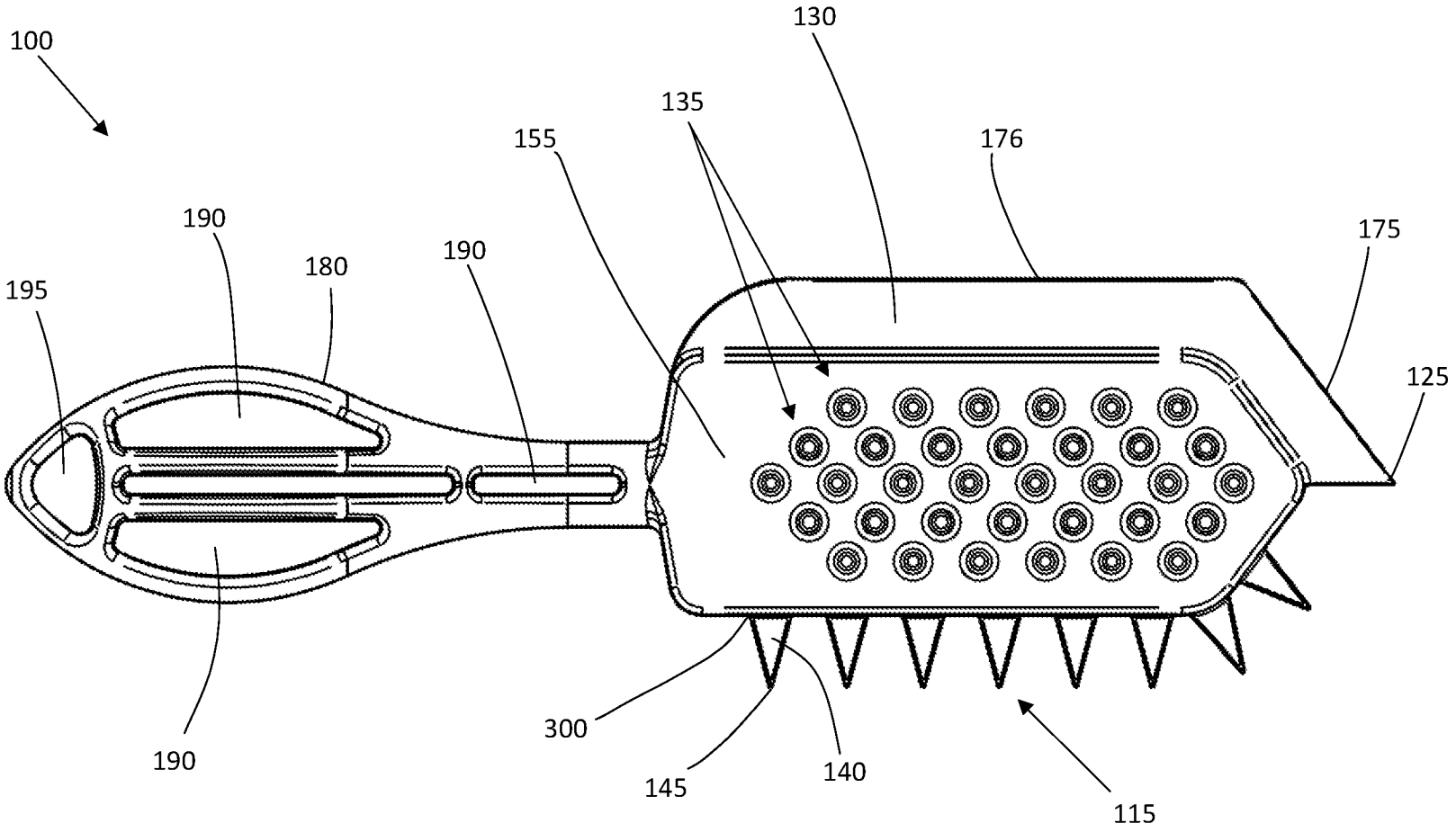
FIG. 5 is a bottom view of the example footwear cleaning device of FIGS. 1-4 in accord with at least some aspects of the present concepts.
Figure 6:
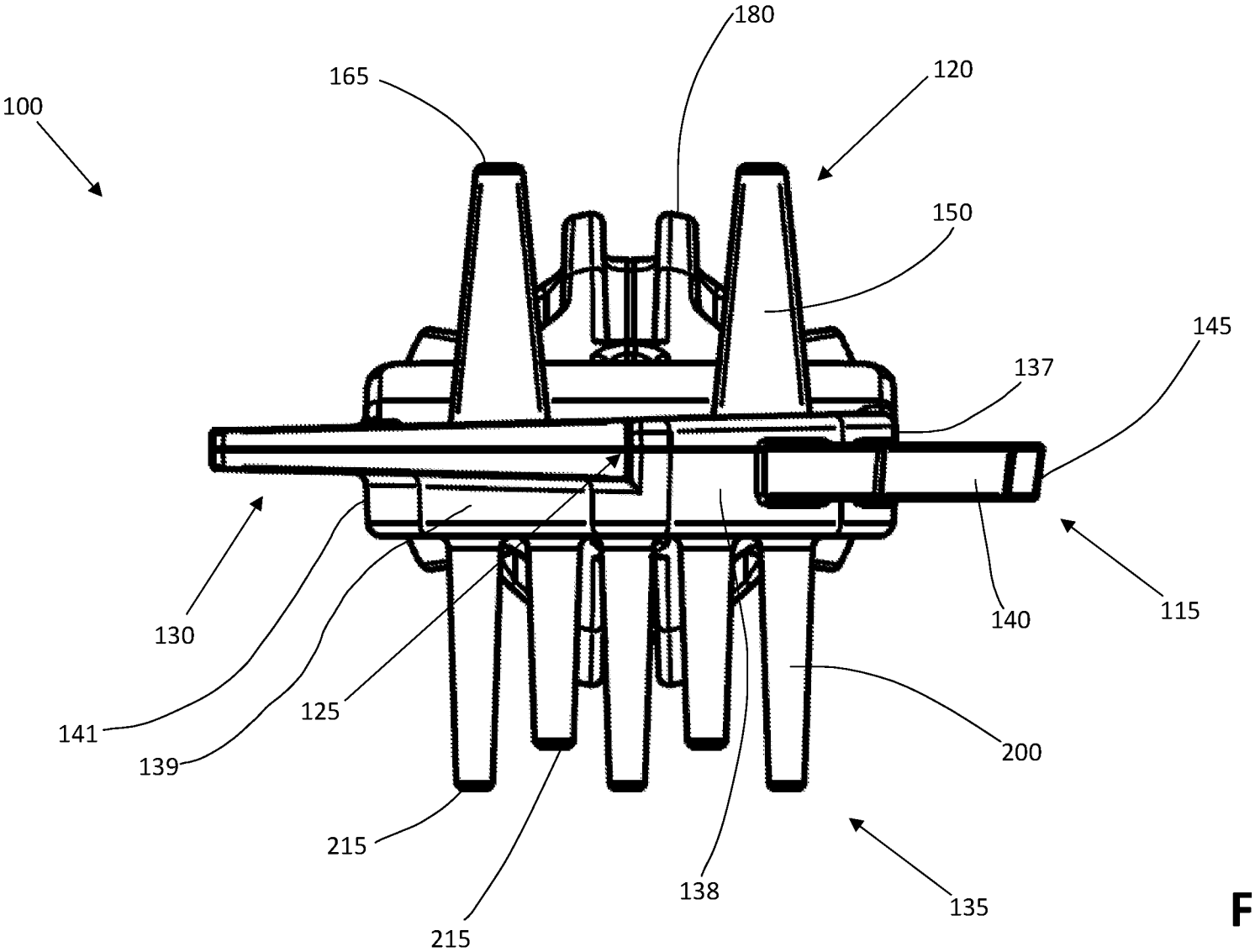
FIG. 6 is a front view of the example footwear cleaning device of FIGS. 1-5 in accord with at least some aspects of the present concepts.

FIGS. 1-2 and 4-6 show the example configuration of example bristles 135 that may be used, for example, to brush away excess debris. FIG. 2 shows the bristles 135 to have an example body 200 extending outwardly from an example proximal or base end 205 attached to or formed with the at an example second surface 210 (e.g., bottom surface of the head 110) and terminating at an example distal end 215. In the example of FIG. 2 and FIGS. 4-6, the distal end 215 is squared off and beveled. In some examples, the bristles 135 are cylindrical. In some examples, such as is shown in FIG. 2 and FIG. 5, the bristles 135 are tapered from the proximal end 205 to the distal end 215. In some examples, the bristles 135 are tapered by between about 1°-7° from a perpendicular to the second surface 210. In some examples, a diameter of the bristles 135 is between about 0.10"-0.25" (e.g., 0.15"). In some examples, the bristles 135 are not circular in cross-section, but are polygonal, and have an outer lateral dimension of between about 0.10"-0.25".

As is best shown in FIG. 5, the bristles 135 are arranged in an example pattern having an example longitudinal center-to-center spacing of about 0.40" and an example lateral center-to-center spacing of about 0.24". In the illustrated example, thirty-four bristles 135 are shown. In some examples, the head 110 may include a greater number (e.g., 40) of bristles 135 or a lesser number (e.g, 20) of bristles 135.

In other examples, the longitudinal center-to-center spacing of the bristles 135 may be less than or greater than the example of 0.40" and the lateral center-to-center spacing of the bristles 135 may be less than or greater than the example of about 0.24". The bristles 135 may be disposed in one or more patterns or arrays. For example, the bristles 135 include a first set of bristles 135 in a first portion of the head 110 and include a second set of bristles 135 in a second portion of the head 110. The first set of bristles 135 and the second set of bristles 135 may have the same characteristics (e.g., pattern, dimensions, material, etc.) or different characteristics.

In some examples, the bristles 135 are of uniform height. For example, all of the bristles 135 are of a height between 0.50" and 1.0" (e.g., 0.56", 0.63", 0.75", etc.). In some examples, the bristles 135 include bristles 135 of more than one height. For example, a first set of bristles has a height of 0.63" and a second set of bristles has a height of 0.75". In some examples, a height of adjacent bristles 135 alternates. For example, the head 110 includes bristles 135 having a first height (e.g., 0.75", etc.) that are adjacent to bristles 135 having a second height (e.g., 0.63", etc.). In some examples, a bristle 135 having a second height is surrounded by adjacent bristles 135 of a first height.

In use, the user grips the handle 105, selects a tool to use from amongst the plurality of tools provided by the footwear cleaning device 100 (e.g., the example spikes 115, the example cleat cleaning tools 120, the example digging tool 125, the example scraping tool 130 and the example bristles 135) and applies the selected tool to debris on the footwear to be cleaned, such as by rubbing the selected tool in a single direction along a surface to be cleaned or by rubbing the selected tool back and forth along a surface to be cleaned. If necessary, the user may then select another tool to use from amongst the plurality of tools provided by the footwear cleaning device 100 (e.g., another one of the example spikes 115, the example cleat cleaning tools 120, the example digging tool 125, the example scraping tool 130 and the example bristles 135) and proceed to apply the selected another tool to debris on the footwear to be cleaned.

Although certain example methods, devices and articles of manufacture have been disclosed herein, the scope of coverage of this patent is not limited thereto. On the contrary, this patent covers all methods, devices and articles of manufacture fairly falling within the scope of the claims of this patent.

What is claimed is:

1. A footwear cleaning device, including:

a handle; and a head connected to the handle, the head including a first tool on a first portion of the head, a second tool on a second portion of the head, a third tool on a third portion of the head, a fourth tool on a fourth portion of the head and a fifth tool on a fifth portion of the head, wherein the first tool, the second tool, the third tool, the fourth tool, and the fifth tool are each different from one another, the first tool comprising pointed spikes, the second tool comprising a first frustrum structure adapted for cleaning between cleats, the third tool comprising a pointed structure adapted for digging, the fourth tool comprising a substantially planar section adapted for scraping, the fifth tool comprising a second frustrum structure adapted for brushing, wherein the handle, the head, the first tool, the second tool, the third tool, the fourth tool, and the fifth tool are a unitary part consisting of only a plastic, a polymer, a thermoplastic elastomer, a thermoplastic polyetherester elastomer or an acetal homopolymer.

2. The footwear cleaning device of claim 1, wherein the handle, the head, the first tool, the second tool, the third tool, the fourth tool, and the fifth tool are inelastic.

3. The footwear cleaning device of claim 1, wherein the first tool includes a plurality of spaced apart spikes extending from a first lateral side of the head, and wherein the plurality of spaced apart spikes extend about 0.44" from the first lateral side.

4. The footwear cleaning device of claim 1, wherein the first tool, the second tool, the third tool, the fourth tool, and the fifth tool have a smooth, non-abrasive surface.

5. The footwear cleaning device of claim 1, wherein the first frustrum structure of the second tool extends from a top surface of the head, and wherein the first frustrum structure of the second tool includes a plurality of the first frustrum structures for cleat cleaning.

6. The footwear cleaning device of claim 5, wherein the first frustrum structures for cleat cleaning extend between about 0.55"-1.25" from the top surface of the head.

7. The footwear cleaning device of claim 6, wherein the second tool comprises four first frustrum structures for cleat cleaning.

8. The footwear cleaning device of claim 1, wherein the third tool is integrated with the fourth tool.

9. The footwear cleaning device of claim 8, wherein the third tool extends axially along a longitudinal axis of the handle and the head.

10. The footwear cleaning device of claim 8, wherein the third tool extends from a front side of the head opposite to a rear side of the head that is connected to the handle.

11. The footwear cleaning device of claim 1, wherein the fourth tool extends from a second lateral side of the head on an opposite side of the head to a first lateral side.

12. The footwear cleaning device of claim 11, wherein the fourth tool extends from the second lateral side by between about 0.40"-0.50".

13. The footwear cleaning device of claim 11, wherein the fourth tool extends along the entire second lateral side of the head.

14. The footwear cleaning device of claim 1, wherein the second frustrum structure of the fifth tool comprises a plurality of second frustrum structures extending between about 0.50"-0.75" from a bottom surface of the head.

15. The footwear cleaning device of claim 14, wherein the plurality of second frustrum structures are arranged in an array.

16. The footwear cleaning device of claim 15, wherein a spacing of the plurality of second frustrum structures along a longitudinal axis of the head is about 0.40".

17. The footwear cleaning device of claim 16, wherein a lateral spacing of the plurality of second frustrum structures is about 0.24".

18. The footwear cleaning device of claim 16, wherein the plurality of second frustrum structures include a first set of second frustrum structures having a first height from the bottom surface of the head and a second set of second frustrum structures having a second height from the bottom surface of the head.

19. The footwear cleaning device of claim 1, wherein the handle and the head are coaxial.

* * * * *